US008046946B2

(12) United States Patent
Packer et al.

(10) Patent No.: US 8,046,946 B2
(45) Date of Patent: Nov. 1, 2011

(54) SHOT-COUNTING DEVICE FOR A FIREARM

(75) Inventors: Kenneth F. Packer, Naperville, IL (US); Alan D. Wilks, Mount Prospect, IL (US); Peter J. Schubert, Naperville, IL (US); Thomas E. Long, Downers Grove, IL (US)

(73) Assignee: Packer Engineering, Inc., Naperville, IL (US)

( * ) Notice: Subject to any disclaimer, the term of this patent is extended or adjusted under 35 U.S.C. 154(b) by 991 days.

(21) Appl. No.: 11/651,722

(22) Filed: Jan. 10, 2007

(65) Prior Publication Data

US 2010/0251586 A1 Oct. 7, 2010

Related U.S. Application Data

(60) Provisional application No. 60/836,977, filed on Aug. 11, 2006.

(51) Int. Cl.
*F41A 9/53* (2006.01)

(52) U.S. Cl. ..... 42/1.01; 324/200

(58) Field of Classification Search ..... None
See application file for complete search history.

(56) References Cited

U.S. PATENT DOCUMENTS 2,957,391 A * 10/1960 Lovercheck ..... 89/28.05
3,914,996 A * 10/1975 Davis et al. ..... 73/167
3,993,946 A * 11/1976 Makino ..... 324/207.21
4,001,961 A * 1/1977 Johnson et al. ..... 42/1.03
4,810,965 A * 3/1989 Fujiwara et al. ..... 324/207.22
5,052,138 A * 10/1991 Crain ..... 42/1.02
5,402,678 A * 4/1995 Fritz et al. ..... 73/167
5,566,486 A * 10/1996 Brinkley ..... 42/1.02
5,778,725 A * 7/1998 Kirschner et al. ..... 73/167
5,799,432 A * 9/1998 Wright et al. ..... 42/1.02
6,286,240 B1 * 9/2001 Collins ..... 42/70.08
6,412,207 B1 * 7/2002 Crye et al. ..... 42/70.06
6,643,968 B2 * 11/2003 Glock ..... 42/1.02
7,248,037 B2 * 7/2007 Hara et al. ..... 324/207.24
7,661,217 B2 * 2/2010 Pikielny ..... 42/1.01
7,716,863 B1 * 5/2010 Johnson et al. ..... 42/1.02
2004/0250615 A1 * 12/2004 Alberti et al. ..... 73/167
2005/0114084 A1 5/2005 Johnson et al.
2005/0155420 A1 * 7/2005 Johnson et al. ..... 73/167
2006/0042142 A1 * 3/2006 Sinha ..... 42/1.01
2006/0156804 A1 * 7/2006 Shipman et al. ..... 73/167
2008/0190191 A1 * 8/2008 Martin et al. ..... 73/167
2008/0276517 A1 * 11/2008 Delgado Acarreta ..... 42/1.02
2009/0007476 A1 * 1/2009 Mauch et al. ..... 42/1.01

* cited by examiner

*Primary Examiner* — Michael Carone
*Assistant Examiner* — Samir Abdosh
(74) *Attorney, Agent, or Firm* — Leydig, Voit & Mayer, Ltd.

(57) ABSTRACT

A device for counting shots fired by a firearm including a permanent magnet mounted to moving portion of the firearm and electrically coupled to a coil mounted on a relatively stationary portion of the firearm. Movement of the magnet relative to the coil induces an electromotive force within the coil. The induced electromotive force can be used increment a shot-count indictor and thereby record the number of shots fired by the firearm. The electromotive force can also be measured by a verification circuit to determine the strength of a shot and thereby verify whether a round was actually discharged by the firearm. In some embodiments, information regarding the number of shots discharged and the strength of the shots can be transmitted to an external device.

18 Claims, 8 Drawing Sheets

SHOT-COUNTING DEVICE FOR A FIREARM

This patent application claims the benefit of U.S. Provisional Patent Application No. 60/836,977, filed Jun. 30, 2006, herein incorporated by reference in its entirety.

BACKGROUND OF THE INVENTION

Various types of guns and firearms such as rifles and pistols exist for discharging or shooting projectiles. It is desirable to count and maintain track of the number of shots that a particular firearm has discharged. Such information is important for several purposes including estimating the time for service or remanufacture, assessing warranty validity, determining the value of the firearm, or for investigation of forensic evidence. Certain prior art references describe devices for counting and tracking the number of shots discharged from a weapon including shot-counting devices having electronic or digital readouts. By way of example, U.S. Patent Publication No. 2005/0155420 titled "Device for Collecting Statistical Data for Maintenance of Small-Arms" by Johnson and Kulesza, published on Jul. 21, 2005, and U.S. Patent Publication No. 2005/0114084 also titled "Device for Collecting Statistical Data For Maintenance of Small-Arms" by Johnson, Kulesza, and VanEvery, published on May 26, 2005, purport to disclose electronic shot counting devices, both of which are herein incorporated by reference in their entirety. These publications generally describe a microprocessor, an interface, and a sensor such as a temperature, acceleration, or an acoustic sensor.

It is important that electronic shot-counting devices do not impair or interfere with the operation of the firearm, but still be simple and rugged enough to withstand discharge and operation of the firearm. It is also important that the shot-counting device be reliable and accurately track the number of actual shots fired or discharged. Moreover, it is desirable that the shot-counting device be lightweight, not require a bulky external power source, and be easily integrated into the design and manufacture of the firearm.

BRIEF SUMMARY OF THE INVENTION

A shot-counting device and method are provided. In a preferred embodiment, a permanent magnet is mounted to a moving portion of the firearm, and at least a portion of a coil or loop of conductive wire is mounted to a non-moving portion of the firearm. The magnet and coil are positioned such that the coil is magnetically coupled to the magnet and the magnet flux through the coil can change as the magnet moves. This relative motion between the magnet and coil induces or generates an electromotive force (EMF) that can be used for the purposes of providing power to a processor or shot-count circuit and for indicating that a shot has been fired. The change in magnetic flux due to relative motion between the magnet and coil, the number of windings in the coil, and the proximity between the magnet and coil are configured so that sufficient power is provided for the processor and to increment the shot-count indicator.

Furthermore, in another aspect, the strength of the EMF generated or induced in the coil is related to the speed with which the moving portion of the firearm and the magnet mounted thereto move relative to the coil. The shot-counting device can thus include a verification circuit that gathers further information about the shot fired or discharged. Such information can relate to dry firing, hand actuation of the moving portion, firing with a light load or firing with a heavy load. In another aspect, during the event of rapid firing of the firearm, the EMF generated in the coil may be sufficient to enable the processor or shot-count circuit to gather data on the firing rate, which may be useful in assessing barrel temperature and other details.

In a further aspect, the verification circuit that determines the strength, potential, or amount of the EMF available, together with algorithms in the processor, can decode or manipulate the information gathered about the shots discharged and store that information into a memory, preferably a non-volatile memory. The device can also include a readout unit by way of which the stored information can be transmitted to an external device such as a computer. Examples of such readout units include inductive radio frequency identification (RFID), electrical connectors (such as USB ports, UART ports, etc.), infrared (IR) transmission, or electromagnetic radiation transmissions.

An advantage of the shot-counting device is that it coverts the mechanical energy inherent in the discharge of a firearm to electrical energy. A related advantage is that the generated electrical energy can be used to count and track the number of shots discharged by the firearm. Another related advantage is that the generated electrical energy can be used to verify whether a shot actually occurred. These and other advantages and features of the present invention will be readily apparent from the following drawings and detailed description of the embodiments.

DETAILED DESCRIPTION OF THE EMBODIMENTS

Figure 3:
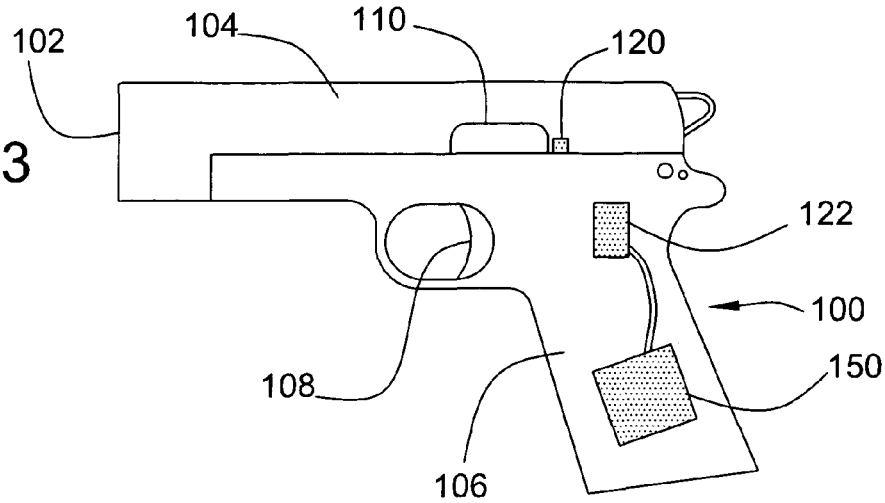
FIG. 3 is a simplified elevational view of a firearm equipped with a shot-counting device illustrating another possible location for the magnet and coil of the device.
Figure 2:
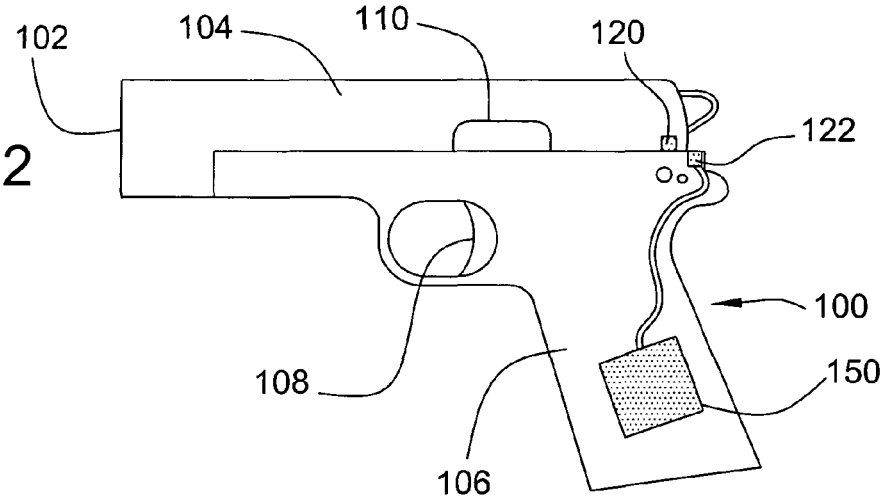
FIG. 2 is a simplified elevational view of a firearm equipped with a shot-counting device illustrating another possible location for the magnet and coil of the device.
Figure 1:
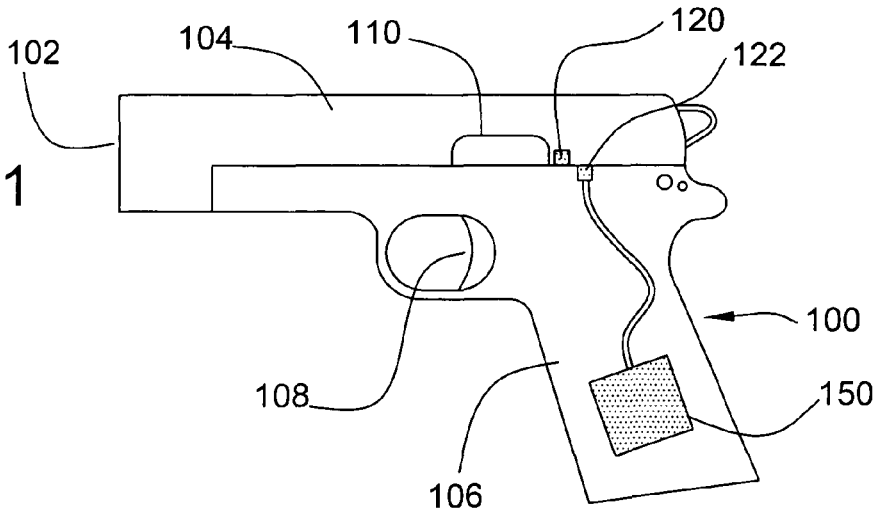
FIG. 1 is a simplified elevational view of a firearm equipped with a shot-counting device and illustrating one possible location for a magnet and coil of the device.

Now referring to the drawings, wherein like reference numbers refer to like elements, there is illustrated in FIGS. 1-3 a firearm 102 equipped with a shot-counting device 100 for counting shots discharged from the firearm. While the particular firearm illustrated is a clip-loaded pistol, it should be appreciated that the shot-counting device can work with other types of firearms such as rifles, and with other types of guns such as air guns and paintball guns that are not true firearms. Accordingly, the term "firearm" herein refers generally to all these and similar types of guns and projectile discharging devices.

The semiautomatic clip-loaded pistol 102 has a movable portion such as a movable slide 104 that can move linearly rearward and forward with respect to a respectively non-moving or stationary portion such as the handle or handgrip 106 of the pistol which can receive the clip. When the trigger 108 is pulled discharging the pistol 102, the movable slide 104 is forced linearly rearward by the recoil of the shot, and then moves forwards by spring action to insert another round into the firing chamber 110 while simultaneously ejecting the shell and residue of the spent round via the ejector mechanism proximate the firing chamber.

The shot-counting device 100 includes a permanent magnet 120, such as prepared from a mixture of neodymium, iron and boron, which is a mounted to the movable slide 104 or perhaps another movable portion such as a firing pin. The permanent magnet 120 will therefore move back and forth with each shot discharged. The shot counting device 100 also includes a loop or coil 122 of conductive wire, or at least a portion thereof, which is mounted to the non-moving portion 106 of the pistol in such proximity with the magnet 120 as to be electromagnetically coupled therewith. Any suitable configuration of the positioning or location of the magnet 120 and coil 122 on the respective portions of the firearm can be used. For example, referring particularly to FIG. 1, the magnet 120 and coil 122 can be mounted in close proximity just behind the firing chamber 110. Referring to FIG. 2, the magnet 120 can be mounted to the rear of the movable slide 104 and the coil 122 can be mounted at the rear, top edge of the handgrip 106. Referring to FIG. 3, a larger version of the magnet 120 can be mounted to the movable slide 104 proximate the firing chamber 110 and larger version of the coil 122 can be mounted at a position on the handgrip 106 at a somewhat greater distance. In this embodiment, the increased size of the magnet and coil will maintain the electromagnetic coupling between them even though the distance between them may be greater.

Because of the magnetic coupling of the magnet 120 and coil 122, when the pistol 102 is discharged causing motion of the slide 104 and the magnet mounted thereto with respect to the handgrip 106, the coil will experience a change in magnetic flux due to the relative movement of the magnet. The magnetic flux ($\phi$) through a loop of the coil can be determined by the following equation:

$$\Phi = B*A*\cos\theta \qquad \text{(Equation 1.1)}$$

Wherein B is the magnetic induction, A is the area of a loop of the coil, and $\theta$ is the angle between the induction field and a line perpendicular to the plane of the coil loop. By Faraday's law, the change over time of magnetic flux through a loop of the coil gives rise to an induced electromotive force (EMF) in the coil by the equation:

$$E = -(\partial\Phi/\partial t) \qquad \text{(Equation 2.1)}$$

Wherein the electromotive force E is given in units of volts, and this force can drive a current through a circuit. Further, the amount or potential of the EMF produced can be increased by providing the coil with a number N of loops of winding by the equation:

$$E = -N(\partial\Phi/\partial t) \qquad \text{(Equation 3.1)}$$

As will be appreciated by those of skill in the art, to maximize the amount of EMF induced by the relative motion between the slide 104 and magnet 120 mounted thereto and the coil 122, the following properties of the coil can be adjusted or optimized: (1) a large area A; (2) a large number of windings; (3) close proximity to the magnet; and (4) perpendicular orientation to the magnet field. Such a coil could be produced by embedding a squat solenoid coil in the handgrip or non-moving portion of the firearm. In some embodiments, the permanent magnet and the coil 122 can be mounted integrally with their respective portions of the firearm at the time of manufacturing the firearm, while in other embodiments, existing firearms can be retrofitted with the magnet and coil.

Figure 4:
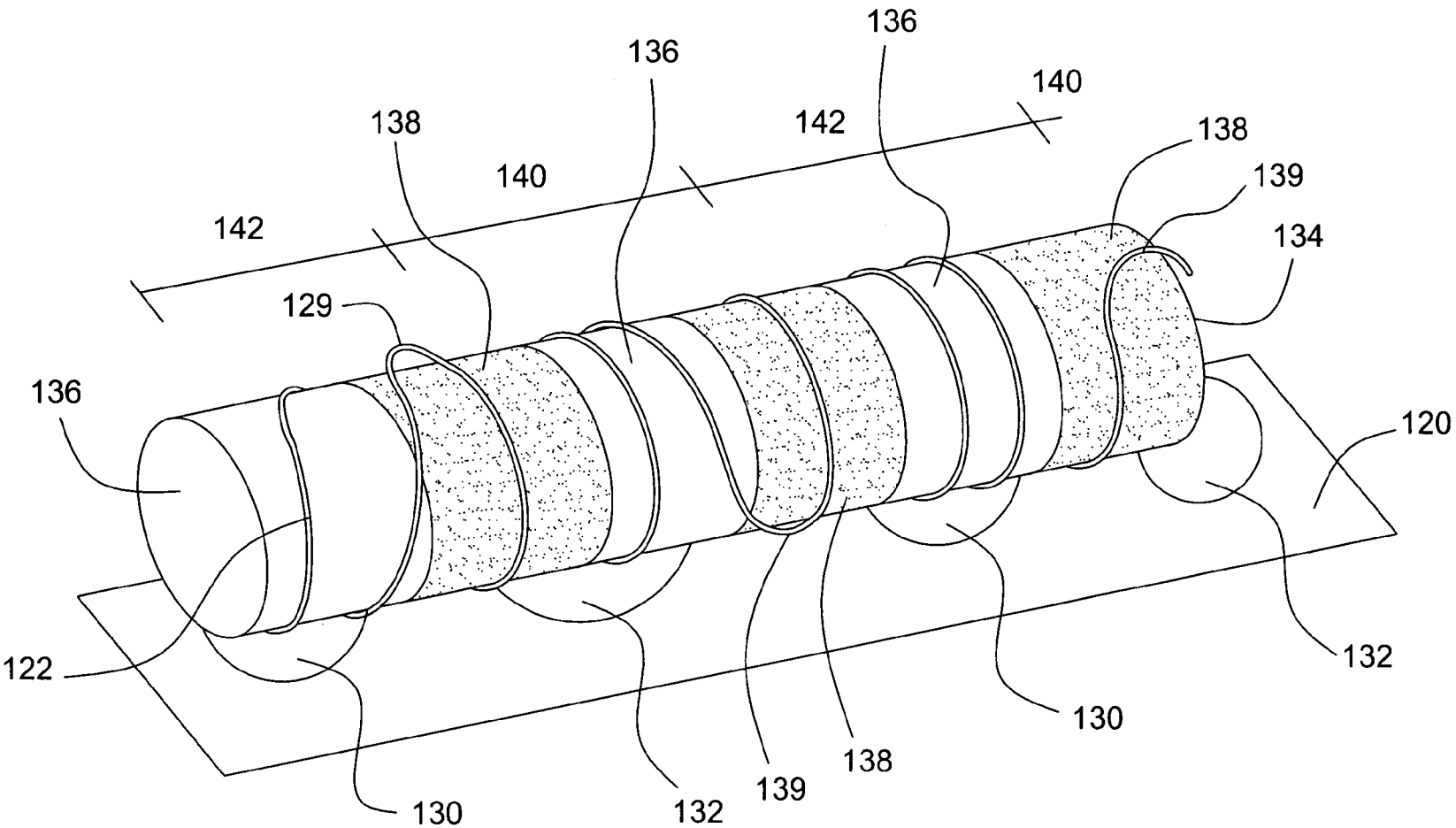
FIG. 4 is a perspective view illustrating one possible embodiment of the magnet and coil.

FIG. 4 illustrates in a general fashion the operation of one possible embodiment of the magnet 120 and winding 122. The magnet 120 can include a plurality of poles 130, 132 bored into the non-moving portion 106 of the firearm. The poles alternate between north poles 130 and south poles 132. Located proximate the magnetic 120 is the coil 122 which can be made from a single length of wire. The windings of the coil are made around a cylindrical core 134 which has alternating segments of highly magnetizable material 136 and material of low magnet susceptibility 138. For example, iron could be used for the material of the highly magnetic segments 136 while polymeric material could be used for the segments of low magnetic material 138. The density or number of the coil windings around the highly magnetic segments 136 should be relative large while the density of the coil windings around the segments of low magnetic susceptibility 138 can be relatively small. Furthermore, the direction of the coil windings (clockwise 140 or counter-clockwise 142) is reversed from one magnetic segment 136 to the next magnetic segment 136. The alternation of the winding direction can occur around the segments of low magnetic susceptibility 138. Furthermore, the spacing between the clockwise and counter-clockwise segments is preferably the same as the spacing between the north and south poles 130, 132 of the magnet 120, as indicted by winding turns 139. The net effect is to have a coil 122 of continuous wire in which the winding loops alter in winding direction and are spaced apart so that the magnetic fields can enter. When the coil passes the magnet poles 130, 132 of altering polarity (north-south as opposed to south-north), the magnetic flux induced into each of the clockwise windings 140 and counter-clockwise windings 142 adds together to increase the overall EMF induced in the coil 122. In various embodiments, the windings and core could be encased in a plastic material to hold the components together.

Referring back to FIGS. 1-3, the shot-counting device 100 can also include a shot-count circuit 150 that utilizes the EMF induced in the coil 122 by the movable magnet 120 for counting the number of shots discharged by the firearm 100. Electrical connection between the coil 122 and the shot-count circuit 150 can be accomplished with wires or insulated pass-throughs. The shot-count circuit 150 can be an electrical component or system of components that preferably are located on a non-moving portion of the firearm 100 such as the handgrip 106 in such a position that the shot-count circuit is not exposed to heat, pressure shock, electromagnetic interference, and corrosive gasses associated with the firing of a bullet.

Figure 5:
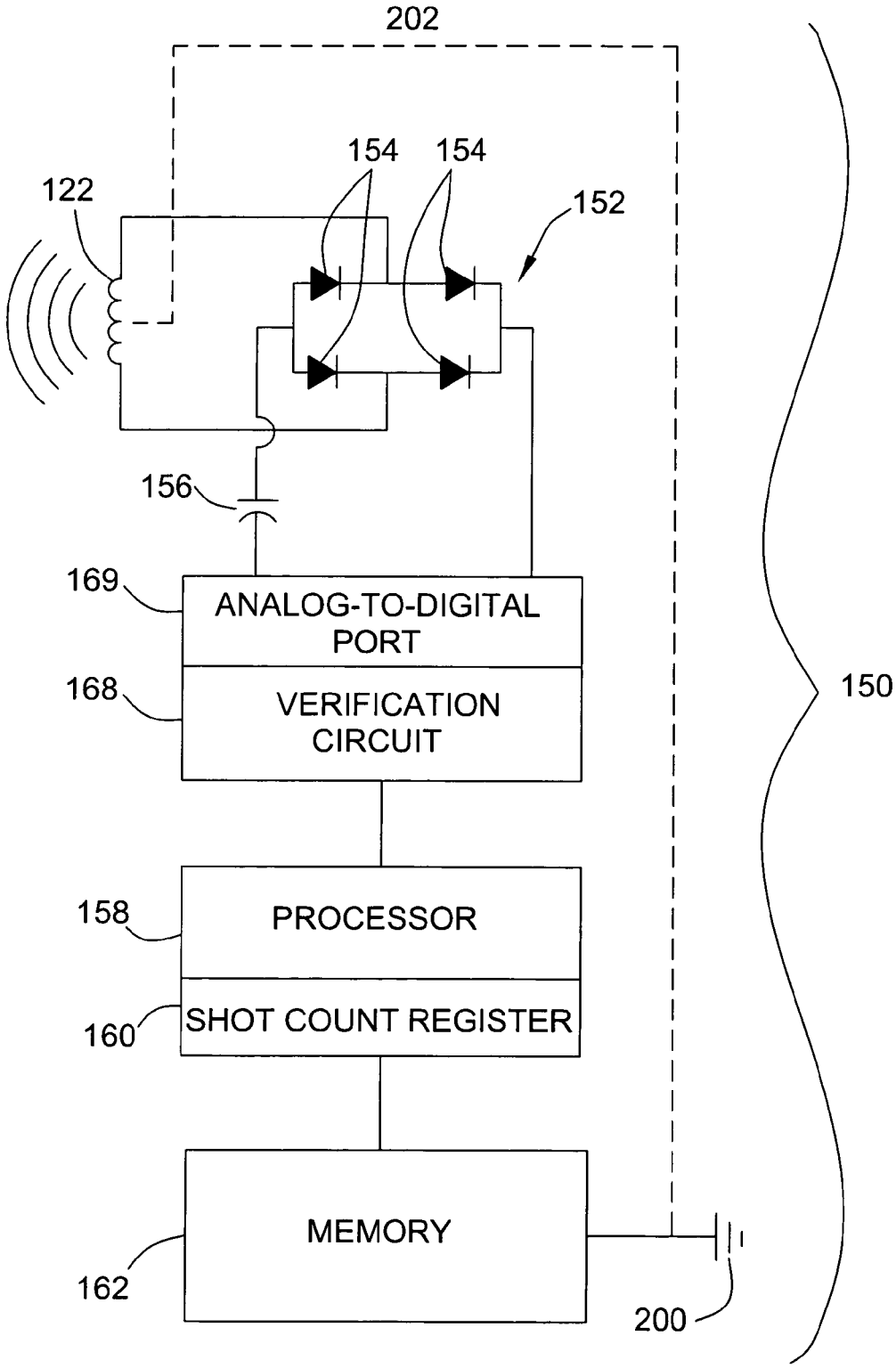
FIG. 5 is a simplified electrical schematic of the shot-counting device depicting in part electromagnetic communications between the magnet, coil, verification circuit, and processor.

FIG. 5 illustrates an embodiment of the shot-count circuit 150. While the various components of the shot-count circuit are shown in a particular arrangement and association, and some features may in other embodiments overlap or merge, it should be recognized that FIG. 5 is illustrative only and not intended as a limitation on the invention. Accordingly, all such configurations of the shot-count circuit components consistent with the description of feature and functions provided herein are contemplated. The illustrated shot-count circuit 150 is in electrical communication with coil 122 to receive the induced EMF. Because of rearward and forward motion of the slide and the magnet 120 mounted thereto, the EMF induced in the coil 122 will be first of one polarity, and then of the opposite polarity, as the magnetic flux will alternate between positive and negative. To modify this alternating current to direct current that the other electronic components can accept, the shot-count circuit 150 can include a circuit or rectifier 152 which will pass current in one direction but not the other. In the particular embodiment illustrated, a full-wave rectifier 152 includes four diodes 154, attached in the familiar way in both series and parallel, and in electrical communication with the coil 122. However, in other embodiments, a half-wave rectifier can be used to the same effect. Moreover, in some embodiments, the other components of the shot-count circuit can operate from the alternating current as it is induced in the coil and the rectifier can be eliminated.

The illustrated shot-count circuit 150 can also include a primary capacitor 156, capable of storing a charge, in electrical communication with and connected in series to the rectifier 152. Hence, the capacitor 156 can receive a charge in response to the induced EMF resulting from discharge of the firearm. One function of the primary capacitor 156 can be to protect the other shot-count circuit components against spikes in the induced EMF and resulting current which may occur due to the violent discharge of the firearm. However, in some embodiments, the other shot-count circuit components may be sufficiently rugged to withstand such spikes and the primary capacitor may not be necessary.

The shot-count circuit 150 can also include a processor 158 that can also be in electrical communication with the coil 122. As illustrated, processor 158 is connected in series with the primary capacitor 156. The processor 158 can be any suitable type of logic circuit including, for example, an application specific programmable integrated circuit (ASIC), a microprocessor, or a field-programmable gate array (FPGA). The processor 158 can include at least one shot-count indicator 160, which may be a register, and which can represent the number of shots fired. During discharge of the firearm, the induced EMF can first be converted by the rectifier 152, then charge the primary capacitor 156, which is then discharged to activate or boot-up and power the processor 158. In other embodiments, a small battery or charge store may be included to partially power the processor and/or other electric components. To account for short pulse resulting from the brief firearm discharge time, the first operation of the processor is to increment the shot-count indicator 160. The information concerning the shot-count can then be transmitted to a memory circuit 162 which is preferably non-volatile and in communication with the processor 158. Furthermore, the primary capacitor 156 can be completely discharged during or after the shot-counting process to ready it for a subsequent shot. This is a basic method by which shot-counting can be accomplished and for some embodiments no further signal processing may be required.

However, incrementing a shot-count indicator in response to each movement of the magnet relative to the coil potentially may over represent the actual number of shots fired. This is because of, for example, hand actuation of the slide when cocking the firearm that may cause the shot-count indicator to increment. To verify whether an actual shot has occurred, the shot-count circuit 150 can include a verification circuit 168 that gathers further information about the shot fired or discharged to determine the intensity of the shot. More specifically, referring to FIG. 5, the verification circuit 168 can be electrically coupled with the other components of the shot-count circuit so as to receive, directly or indirectly, electrical energy in response to the EMF induced in the coil 122. Because the strength of the EMF induced in the coil 122 is related to the speed at which the slide and magnet attached thereto move with respect to the coil, the amount or power of electrical energy received by the verification circuit 168 represents the speed of the slide and thus the intensity of the magnetic movement representing the shot. In various embodiments, after determining the intensity of the magnet movement, the verification circuit can determine whether a shot has actually occurred and, if not, could de-increment the shot count indicator.

The intensity of the shot can be measured in various ways. Referring to FIG. 5, one relatively direct method is to include an analog-to-digital port 169 as part of the device, which may be part of a separate verification circuit 168 or may be located on the processor 158. Energy from EMF induced into the coil 122 can be directed to the analog-to-digital port 169 where the analog input is converted to a digital signal for processing. The verification circuit 168 or processor 158 can then manipulate the digital signal through various digital signal processing operations, for example to determine the maximum voltage (Vmax) induced in the coil, and thereby determine the corresponding intensity of the firearm discharge.

Another way of determining shot intensity is to measure the rate of decay of the charge produced by EMF induced in the coil. For example, referring to FIG. 6, the verification circuit 168 can include a voltage regulator 170 (or voltage regulating circuitry) connected to the primary capacitor 156. The voltage regulator 170 can also provide an output voltage to the other components of the shot-count circuit, and thus acts as a bridge between the primary capacitor 156 and the processor. Further, the primary capacitor 156 is coupled back to the coil 122 in such a manner that the magnitude of induced EMF will translate monotonically to the charge stored in the capacitor. Hence, the amount of charge on the primary capacitor 156 will translate monotonically to the speed with which the slide on the firearm moves. If the other components of the shot-count circuit are configured to consume a predicable amount of current, or configured to draw current through a known resistance, the length of time the shot-count circuit can operate (until the voltage level falls to low) can be used to determine the speed of the slide motion and hence the intensity of the discharge. After determining the discharge intensity, the primary capacitor can be completely discharged to ready it for a subsequent discharge of the firearm.

Figure 7:
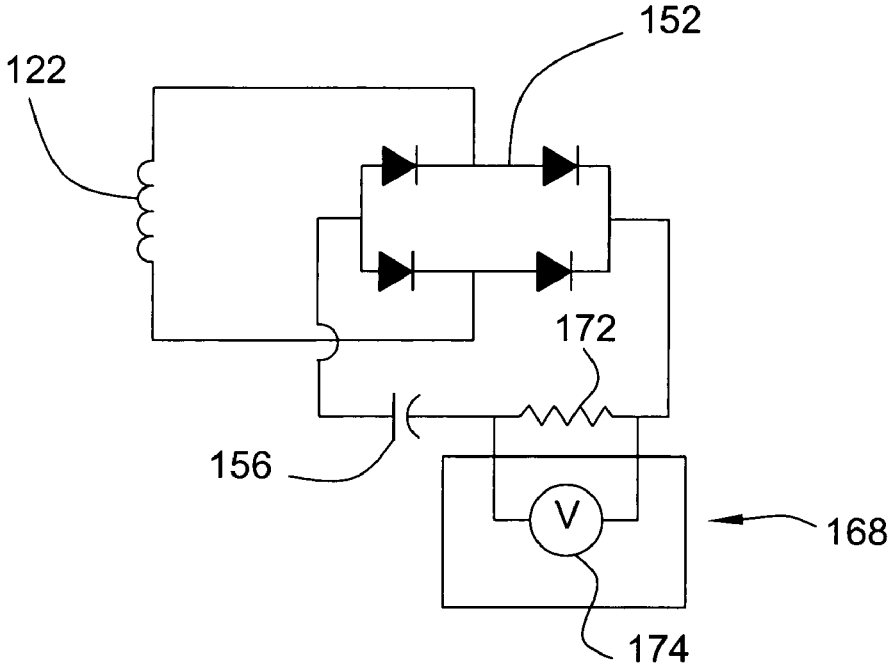
FIG. 7 is a simplified electrical schematic depicting an embodiment of the verification circuit including a resistor and voltmeter.

Another embodiment of the verification circuit 168 which operates by measuring the decay of the charge resulting from the induced EMF is illustrated in FIG. 7. In the illustrated embodiment of the verification circuit 168 the primary capacitor 156 is in electrical communication with the coil 122 via the rectifier 152. Thus, charging of the capacitor can occur in response to the EMF induced in the coil 122 by motion of the slide and the magnet mounted thereto. The magnitude of the charge on the primary capacitor 156 can then be estimated by allowing the charge to decay through a known resistor 172, connected in series with the capacitor, and sensing the voltage drop across the resistor 172 at two fixed points in time by, for example, a voltmeter 174. The measured voltage values taken at the two points in time are fitted to an exponential function, and the intercept point is deduced for the voltage value at time t=0 by the equation:

$$V(t)=V(0)e^{-t/RC} \quad \text{(Equation 4.1)}$$

The decay of the charge follows from Equation 4.1, and by knowing the resistance R of the resistor 172 and the capacitance C of the primary capacitor 156, the maximum voltage at time t=0 can be derived. Next, also by knowing the capacitance C of the primary capacitor 156, the maximum charge (Q at time t=0) can be determined by the following:

$$Q(0)=CV(0) \quad \text{(Equation 5.1)}$$

From knowing the maximum charge Q of the capacitor 156 at time t=0, the intensity of the shot can be derived or inferred. Once the readings have been taken, it may be advantageous to drain away any remaining charge on the primary capacitor to ready it for subsequent discharge of the firearm.

Figure 8:
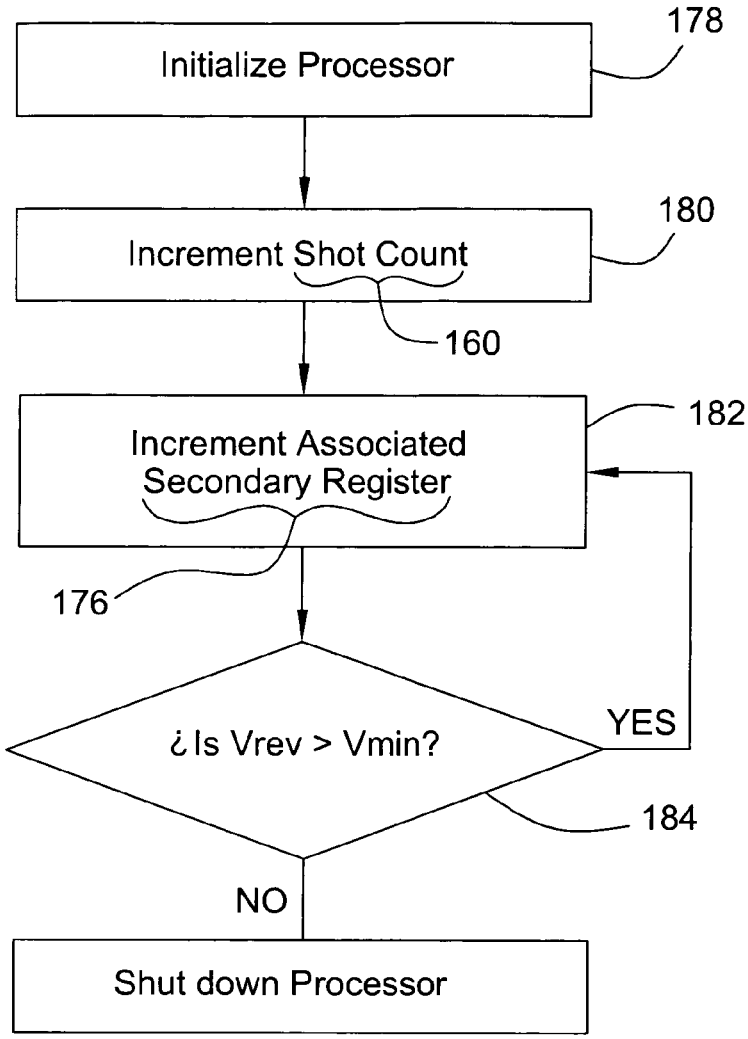
FIG. 8 is a flowchart depicting another embodiment of the verification circuit operating by comparing voltages.

Another embodiment of the verification circuit 168 that determines shot intensity by decay of charge representing the induced EMF is illustrated by the flow chart in FIG. 8. In this embodiment, a preset voltage Vmin. at which the counting circuit can just still operate reliably is first determined. Additionally, a second register 176 is provided, either within the processor or the non-volatile memory, which can be associated with the register serving as the shot-count indicator 160. In operation, after the shot has been discharged and the EMF induced in the coil, the processor is initialized at step 178 and the shot-count indicator 160 is incremented at step 180. Following incrementing of the shot-count indicator, the second register 176 can be incremented at a rapid rate in step 182. In the next step 184, the voltage resulting from the induced EMF, Vref., is compared to the preset voltage Vmin. If the value of the induced voltage Vref. remains greater than the preset voltage Vmin, the second register 176 continues to increment. If the value of the induced voltage Vref. falls below the preset voltage Vmin., the incrementing of the second register is halted. The final count of the second register 176 will be a measure of the decay rate of the maximum charge induced by the EMF, and can thereby relate to the intensity of the shot.

Figure 9:
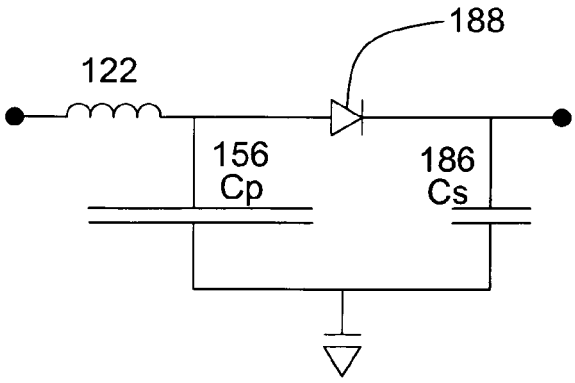
FIG. 9 is a simplified electrical schematic depicting another embodiment of the verification circuit having at least two capacitors.

One further embodiment of a verification circuit 168 for determining shot intensity is presented in FIG. 9. A secondary capacitor 186 is placed in parallel with the primary capacitor 156 with a diode 188 between them. The secondary capacitor 186 has lower capacitance and preferably a low leakage resistance, and will then hold only a fraction of the maximum charge resulting from the EMF induced in the coil. The fraction of the charge in the secondary capacitor 186 can be deduced from the ratio of the primary to the secondary capacitors, or Cs/Cp. After the processor has been initialized, it can sample the secondary capacitor 186 to obtain an indication of the shot intensity. Afterwards, the charge can then be drained from the secondary capacitor readying it for a subsequent shot.

Referring back to FIG. 5, in another aspect of the shot-counting device a further advantage can be gained where shots are discharged in a rapid succession. Specifically, if after an initial shot is discharged, the shot-count circuit 150 and/or the verification circuit 168 are still being powered by the resulting initial discharge at a time a second shot is discharged, the circuits can be configured to determine the time span between the shots, which allows calculation of the firing rate of the firearm. Knowledge of the time span between shots can be used to estimate barrel temperature, which can be a key factor in determining barrel wear and fatigue.

Figure 10:
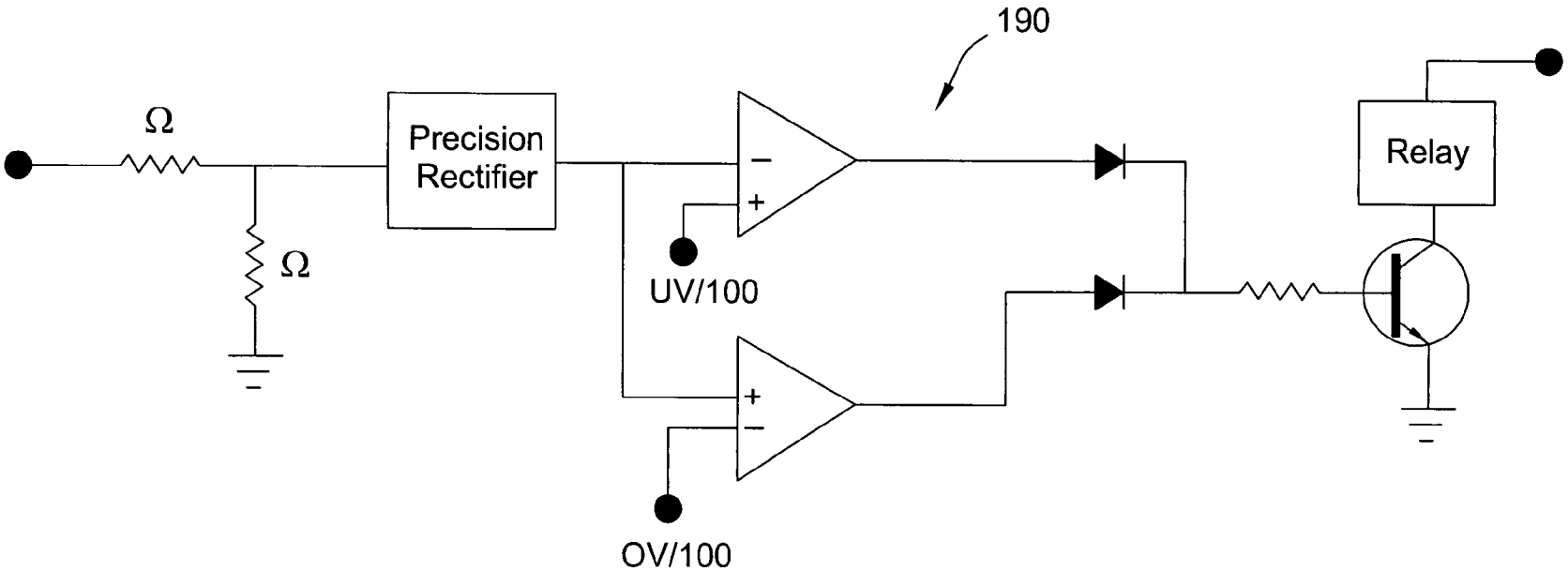
FIG. 10 is a simplified electrical schematic depicting an overload/underload protection circuit for use with the shot-counting device.

In various embodiments of the shot-count circuit, to avoid excessive charge buildup on the primary capacitor during rapid repeated firing, it may be desirable to include an overload protection circuit. An example of such an overload protection circuit 190 is illustrated in FIG. 10. This circuit can prevent damage to the shot-count circuit and verification circuit. In other embodiments, the overload circuit may be absent to avoid possible deterioration in the accuracy of the shot counting and shot intensity measuring. To confront such considerations, in some circumstances it may be possible to presume that shot intensity, once known for an initial shot, will remain consistent for subsequent shots of homogenous projectiles. In such circumstances, an overload device may therefore be included and only the number of shots counted measured.

To analyze the information obtained by the shot-counting device, the information can be downloaded to an external device such as a computer or similar system. For example, referring to FIG. 5, the shot-counting device 100 includes a readout unit 200 that communicates with the non-volatile memory 162. Information concerning the shot number and shot intensity can be stored in the memory 162 and, when desired, transmitted to the external device by the readout unit 200. Further, additional information can also be transmitted by the readout unit to the external device such as the firearm serial number or registration. The readout unit may be any suitable type of transmitting or downloading device such as, for example, serial ports, parallel ports, and/or custom harnesses. In some embodiments, the readout unit can include a visual indicator such as an LED display on an exposed portion of the pistol. In other embodiments, non-contact inductive reading systems can be utilized such as radio-frequency identification (RFID), infrared beaming, and other suitable means. Methods of RFID can include low frequency (LF), high frequency (HF), ultra-high frequency methods (UHF) and can be transmitted by including a relatively flat antenna on the non-moving portion of the gun. In some embodiments, the readout unit 200 can include the inductive coil 122 as the transmitting device, and which is indicated by dashed line 202.

Figure 11:
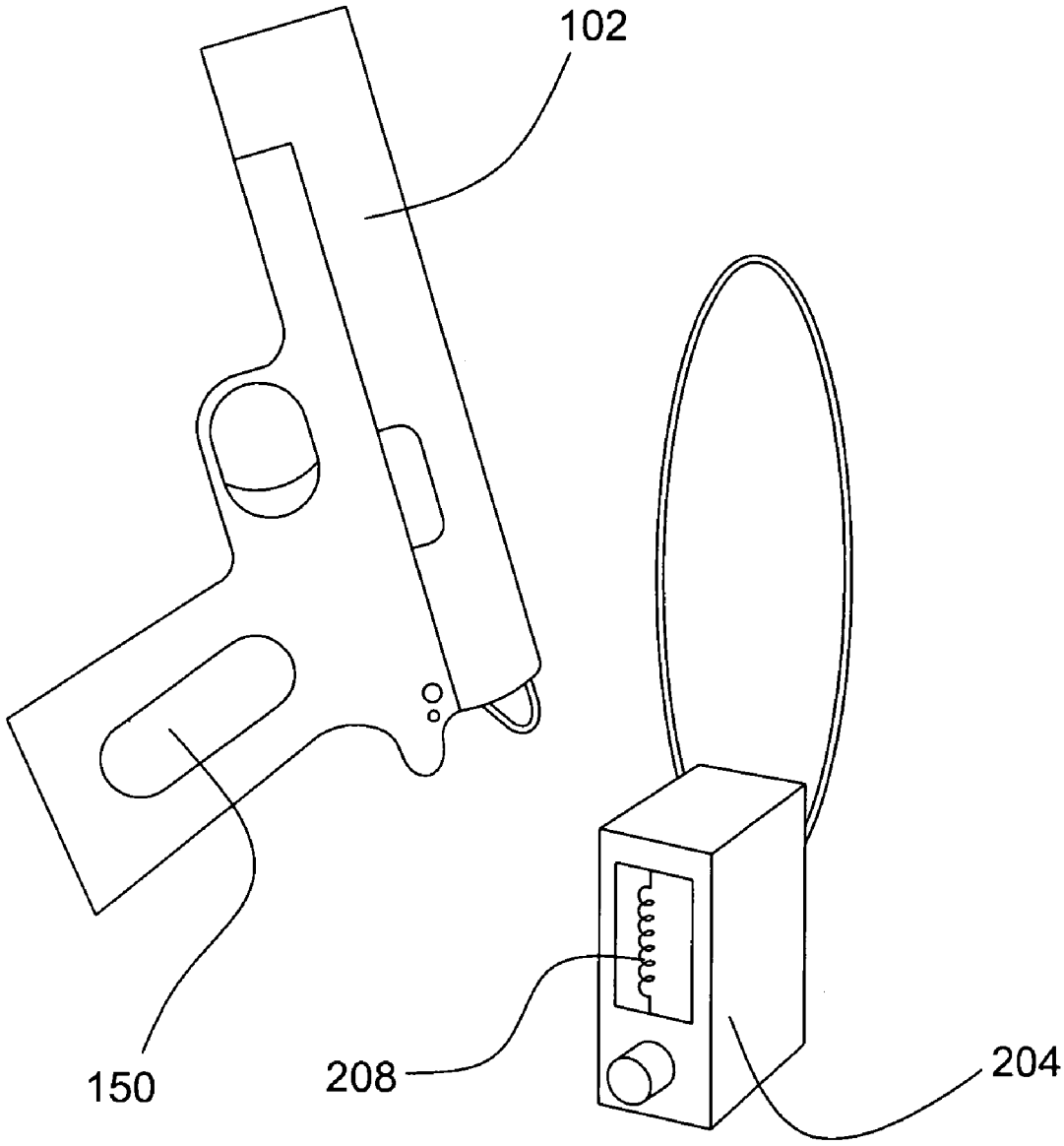
FIG. 11 is a simplified schematic diagram depicting a firearm equipped with a shot counting device in relation to an external device for reading and analyzing information from the shot-counting device.

Referring to FIG. 11, for inductive readout using the inductive coil that powers the shot-counting device 100, the shot-count circuit 150 should be able to sense and make a distinction between the induced EMF resulting from the moving magnet and a readout EMF transmitted by a readout device 204 that is proximate to the firearm 102. To make this distinction, the readout EMF can be an alternating magnetic field having a frequency outside the frequency range of the magnet EMF resulting from firearm discharge. For example, a rapidly alternating magnetic field can be used as the readout EMF transmitted by the external unit 204. The readout EMF can be AM or FM modulated. Then, depending upon the particular embodiment of the shot-count circuit 150, the distinction between magnet EMF resulting from shot discharge and readout EMF transmitted from the readout device 204 can be made in various ways.

Figure 6:
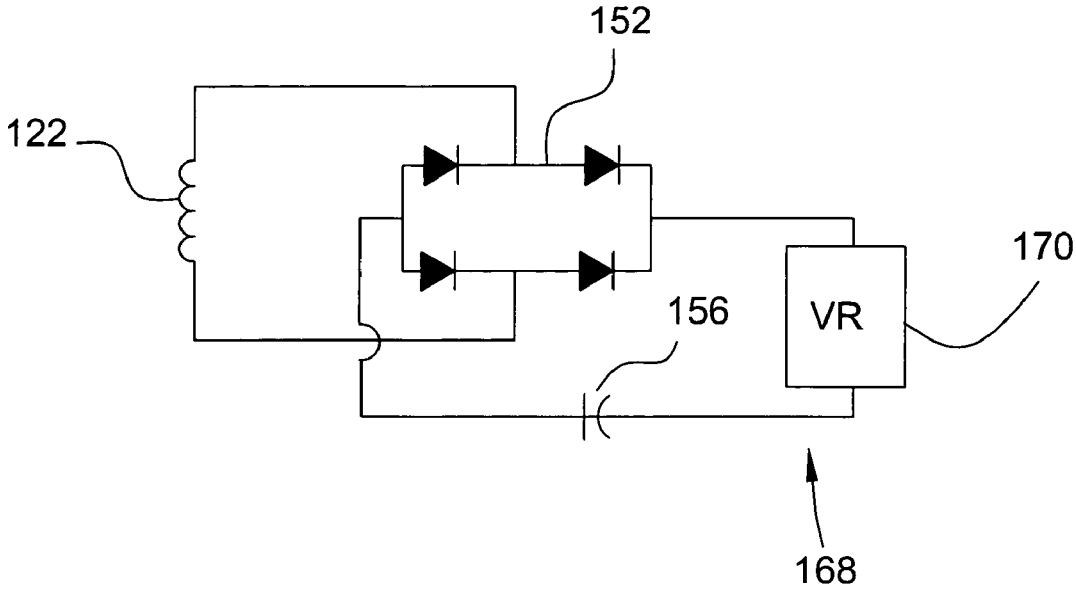
FIG. 6 is simplified electrical schematic depicting an embodiment of the verification circuit including a rectifier and a voltage regulator.

For example, referring to FIGS. 6 and 7, in the embodiments in which the shot-count circuit 150 and the included verification circuit 168 measure the charge decay of a capacitor 156 to determine shot intensity, the presence of the readout EMF (being received by the coil 122) will maintain a maximum charge on the capacitor over time. A detection algorithm in the shot-count circuit 150 can determine when the measured charge decay has been minimal for an extended time and thereby perceive the presence of the readout EMF. Referring to FIG. 8, in the embodiments in which a voltage Vref. (received from the coil) is compared to a preset minimum voltage Vmin. to determine shot intensity, the presence of the readout EMF can maintain Vref. for an extended period of time. Accordingly, the second register 176 will continue to increment to some excessive predefined quantity that should not exist when analyzing only shot discharges. Referring to FIG. 9, in the shot-count circuit 150 embodiments utilizing parallel primary and secondary capacitors 156, 186 to measure shot intensity, the charge on the second capacitor in response to the readout EMF (being received by the coil 122) will begin increasing steadily, indicating the presence of the readout EMF.

Figure 12:
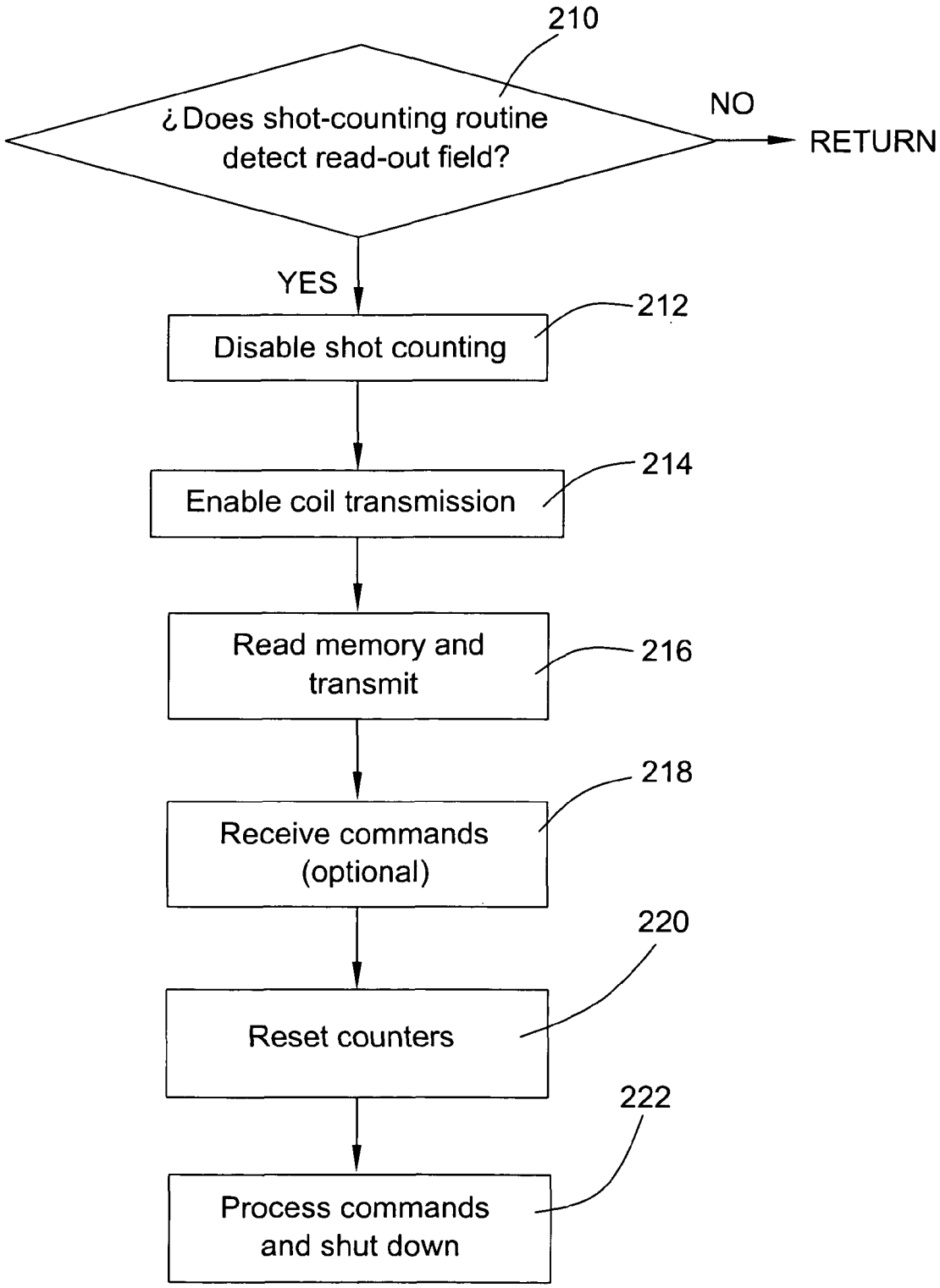
FIG. 12 is a flowchart depicting a method of transmitting information from the shot-counting device to an external device.

Illustrated in FIG. 12 is one possible method of transmitting readout information via the coil once the distinction between magnet EMF resulting from firearm discharge and readout EMF in step 210. If the readout EMF is not present, the shot-counting device can return to its normal operation. But if the readout EMF is present, the shot-count circuit then disables shot counting in step 212, enables coil transmission in step 214, and reads the information from the memory and transmits a signal to the coil in step 216. Referring briefly back to FIG. 11, the readout signals from the coil on the firearm 102 can be received by the external unit 204. More particularly, the external unit 204 can include a download coil 208 mounted thereon which can sense the readout signal, preferably at a specified frequency, and receive the information from the shot count circuit 150 concerning shot count and shot intensity.

In further embodiments, the external unit 204 can be adapted to issue commands back to the shot-count circuit 150 on the firearm 102. Referring back to FIG. 12, the shot-count circuit receives the commands that can be encoded in the readout EMF from the external device in step 218. By way of example, the commands may instruct the shot-count circuit 150 to reset all counters upon the successful readout of information, represented by step 220. Alternatively, this could be done by a preset algorithm in the shot-count circuit. Additionally, there may be a need to communicate specific configuration commands to the shot-count circuit for a variety of functions, as represented by step 222.

The various aspects of the shot-count device can provide a number of benefits and advantages. For example, the magnet and coil design utilizes the mechanical energy inherent in the discharge of a firearm and converts that mechanical energy to electrical energy. Hence, the need for an external power source and/or a battery is reduced or eliminated. Eliminating the need for a battery or reducing the size of the battery that must be included avoids adding additional mass to the firearm and the inconvenience of having to replace batteries. A further advantage is realized in the embodiments wherein the shot-count device is configured to utilize the coil as part of the readout device to transmit information to an external device. These embodiments further reduce weight and eliminate the need for ports that can become clogged and damaged and cables that become lost or broken.

Minimizing the weight of the shot-count device minimizes the weight of the firearm making the firearm easier to handle and to transport. Additionally, the shot-count device adds no additional moving parts to the firearm, lessening concern for wear-out and fatigue and increasing the reliability of the shot-count device. Furthermore, because of the design of the shot-count device, the shot-count circuit and the electronics associated therewith can be located a safe distance from the firing chamber so that damage from heat, shock, pressure, and electromagnetic interference are reduced. This improves the overall ruggedness and reliability of the shot-count device.

Other variations of the description above are possible and contemplated herein. These include but are not limited to: alternate magnetic materials and magnetization configurations; other configurations of the coil, including partial loops; orientation or location of the magnet within the moveable part; location and orientation of the coil; means of connecting the coil to the remainder of the shot-count device, portions or all of which may be mounted on a circuit board or ceramic substrate or consist of a system-on-chip design; alternate shot-count circuit and/or verification circuit designs which accomplish substantially the same function as those described above; the addition of other functions and features; other methods of overload protection known to those skilled in the art; other methods of providing processing capabilities; other forms of non-volatile memory, including erasable memory (EPROM), flash memory, et cetera; other methods by which the read-out function can be communicated to the shot-count circuit via the coil; other methods by which the coil can be used to transmit readout data; any form of readout unit connector technology now known or subsequently developed; partitioning of the various features between different portions of the firearm; and application of these concepts to other firearms besides a pistol, and application of these concepts to other similar devices such as pneumatic guns, vacuum guns, Gauss guns, mass drivers, and so forth.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A shot-counting device for a firearm comprising:

a permanent magnet mountable to a movable portion of the firearm;

at least a portion of a loop of conductive wire mountable to a relatively non-movable portion of the firearm and electromagnetically coupled with the magnet for generating an electromotive force upon motion of the permanent magnet with respect to the loop, the electromotive force sufficient to increment a shot-count indicator;

a shot-count circuit in electrical communication with the loop and receptive to the generated electromotive force, the shot-count circuit including the shot-count indicator;

wherein the shot-count indicator is incremented without the aid of an external power source or a battery.

2. The shot-counting device of claim 1, wherein the loop is one of a plurality of loops of conductive wire that together comprise a coil.

3. The shot-counting device of claim 2, wherein the shot-count circuit includes a processor in electrical communication with the loop, the processor being selected from the group consisting of an application-specific integrated circuit, a microprocessor, and a field-programmable gate array.

4. The shot-counting device of claim 3, wherein the shot-count circuit includes a non-volatile memory in communication with the processor.

5. The shot-counting device of claim 4, wherein the shot-count circuit includes a rectifier communicating with the coil.

6. The shot-counting device of claim 5, wherein the shot-count circuit includes a verification circuit for determining the strength of a shot.

7. The shot-counting device of claim 6, wherein the verification circuit includes a resistor electrically coupled to a primary capacitor and a voltmeter electrically coupled at each end of the resistor to measure voltage drop thereacross.

8. The shot-counting device of claim 6, wherein the verification circuit includes a primary capacitor, a secondary capacitor in parallel with the primary capacitor, and a diode electrically coupled between primary and secondary capacitors.

9. The shot-counting device of claim 6, wherein the verification circuit includes a voltage regulator electrically communicating with the coil.

10. The shot-counting device of claim 6, further including a readout unit communicating with the non-volatile memory, the readout unit selected from the group consisting of a radio-frequency identification transmitter, an electrical connector, an infra-red transmitter, and an inductor coil.

11. The shot-counting device of claim 2, wherein the permanent magnet includes a plurality of magnets arranged to have alternating poles, and the coil includes windings in both the clockwise and counterclockwise directions.

12. The shot-counting device of claim 11, wherein the windings of the coil are around a core having alternating segments of high magnetic susceptibility and low magnetic susceptibility.

13. The shot-counting device of claim 12, wherein the density or number of the windings of the coil is greater over the core segments of high magnetic susceptibility than over the core segments of low susceptibility.

14. A shot-counting device for a firearm, the shot-counting device comprising:

a permanent magnet mountable to a movable portion of the firearm;

at least a portion of a loop of conductive wire mountable to a relatively non-moving portion of the firearm, the loop being in electromagnetically coupled with the magnet for generating an electromotive force upon motion of the permanent magnet with respect to the coil;

a shot-verification circuit receptive to the generated electromotive force for determining the strength of a shot based on the strength of the electromotive force; and a shot count indicator, wherein the shot-count indicator is incremented without the aid of an external power source or a battery.

15. A method of counting shots fired from a firearm, the method comprising:

(i) providing a permanent magnet mounted to a relatively movable portion of the firearm;

(ii) providing at least a portion of a loop of conductive wire mounted to a relatively non-moving portion of the firearm;

(iii) moving the permanent magnet and movable portion relative to the at least a portion of a loop and the non-moving portion of the firearm;

(iv) inducing an electromotive force in the at least a portion of a loop sufficient to increment a shot-count indicator, wherein the shot-count indicator is incremented without the aid of an external power source or a battery; and (v) incrementing a the shot-count indicator in response to the electromotive force.

16. The method of claim 15, further comprising the steps of:

(vi) transmitting information representing the incremented status of the shot-count indicator to a readout unit;

(vii) reading the information from the readout unit.

17. The method of claim 16, wherein the step of transmitting information to the readout unit comprises:

(viii) generating from an external unit a readout electromotive force;

(ix) comparing the readout electromotive force with the induced electromotive force in the at least a portion of a loop; and (x) transmitting the information via the at least a portion of the loop to the external device in response to the comparison.

18. The method of claim 17, wherein the step of comparing further involves determining whether the frequency associated with the readout electromotive force is greater than the frequency associated with the induced electromotive force.

* * * * *